US006901681B2

(12) United States Patent
Bueno

(10) Patent No.: US 6,901,681 B2
(45) Date of Patent: Jun. 7, 2005

(54) SIDING INSTALLATION TOOL, KIT AND METHOD

(76) Inventor: Chrispatrick A. Bueno, 566 Dan Kelly Rd., Port Angeles, WA (US) 98363

( * ) Notice: Subject to any disclaimer, the term of this patent is extended or adjusted under 35 U.S.C. 154(b) by 0 days.

(21) Appl. No.: 10/342,270

(22) Filed: Jan. 15, 2003

(65) Prior Publication Data

US 2003/0101611 A1 Jun. 5, 2003

Related U.S. Application Data

(63) Continuation-in-part of application No. 09/985,519, filed on Nov. 5, 2001, now abandoned.

(51) Int. Cl.[7] ..... G01B 5/14; E04F 21/00

(52) U.S. Cl. ..... 33/647; 33/646

(58) Field of Search ..... D10/64, 69, 70, D10/71; D8/14, 45, 51, 71, 106; 52/DIG. 1; 33/646, 647, 648, 649, 42, 411, 451; 81/177.4, 490

(56) References Cited

U.S. PATENT DOCUMENTS

| | | | | | |
|---|---|---|---|---|---|
| 159,597 | A | * | 2/1875 | Mefford | 33/647 |
| 351,722 | A | | 10/1886 | Trueblood | |
| 396,075 | A | * | 1/1889 | Curtis | 33/411 |
| 424,173 | A | | 3/1890 | Brown | |
| 631,315 | A | | 8/1899 | Beskill | |
| 1,405,393 | A | * | 2/1922 | Bonnell | 33/649 |
| 1,414,556 | A | * | 5/1922 | Dresen | 33/649 |
| 2,716,288 | A | * | 8/1955 | Geddis et al. | 33/648 |
| 3,133,357 | A | | 5/1964 | Gayan | |
| 3,997,053 | A | * | 12/1976 | Bondhus | 206/377 |
| 4,208,799 | A | * | 6/1980 | Frantello | 33/647 |
| 4,473,100 | A | | 9/1984 | Wheeler | |
| 4,879,780 | A | * | 11/1989 | Prebeck | 15/105.5 |
| 4,958,814 | A | * | 9/1990 | Johnson | 269/43 |
| 5,058,465 | A | * | 10/1991 | Womack | 81/487 |
| 5,094,007 | A | | 3/1992 | Gordon | |
| 5,400,519 | A | * | 3/1995 | Meyer | 33/646 |
| 5,564,245 | A | * | 10/1996 | Rademacher | 52/520 |
| 5,623,767 | A | | 4/1997 | Colavito | |
| 5,647,080 | A | * | 7/1997 | Martin | 7/103 |
| 5,692,311 | A | | 12/1997 | Paquin | |
| 5,737,844 | A | * | 4/1998 | Brumley | 33/194 |
| 5,983,759 | A | * | 11/1999 | Turner | 81/177.6 |
| 5,992,625 | A | * | 11/1999 | Loiselle | 206/377 |
| 6,494,016 | B1 | * | 12/2002 | Bankson | 52/749.1 |
| 6,705,021 | B2 | * | 3/2004 | Nadal et al. | 33/647 |
| 2002/0100181 | A1 | * | 8/2002 | Evans | 33/647 |
| 2004/0074188 | A1 | * | 4/2004 | Beck et al. | 52/522 |

* cited by examiner

*Primary Examiner*—R. Alexander Smith
(74) *Attorney, Agent, or Firm*—Siemens Patent Services LC

(57) ABSTRACT

A siding hook and a gauge for positioning a length of siding at a predetermined degree of overlap over an installed length of siding is disclosed. The gauge comprises an elongate slide bar and a stop block slidably mounted on the slide bar. The stop block is clamped to the slide bar by screws which thread into holes formed in the stop block. The heads of the screws are entrapped within the stepped slot of the slide bar. Both the slide bar and the stop block have flat surfaces devoid of projections which could mar siding, and rounded or beveled edges and corners. The siding hook is S-shaped, formed from thin sheet metal or plastic, and configured to overhang the installed siding while supporting a length of siding being installed over installed siding. A measuring device and level are incorporated into the design of the gauge.

17 Claims, 4 Drawing Sheets

SIDING INSTALLATION TOOL, KIT AND METHOD

This application is a Continuation-In-Part of my previous application, Ser. No. 09/985,519, filed on Nov. 5, 2001, abandoned.

BACKGROUND OF THE INVENTION

1. Field of the Invention

The present invention relates to siding installation tools. More particularly, the invention comprises a gauge for positioning overlapping sections of building materials such as siding, clapboard, and roofing shingles during installation.

2. Description of the Prior Art

When overlapping flat sections of building material such as clapboard, roofing shingles, and cedar, concrete or laminate siding are installed on vertical building surfaces, it is desirable to maintain adjacent courses even. Cedar is referred to hereinafter as a preferred wood siding, although other woods are often planed to a similar shape and for purposed of discussion will be considered as cedar. Utilizing standard commercial products, which are usually fairly straight and regularly shaped, this requires placing each succeeding member over a previously installed member such that a constant degree of overlap is established along the lengths of the two members. This can be performed by "snapping a line" or other traditional marking methods. However, it would be more efficient to utilize a method that eliminates marking and which also requires only one mechanic.

An adjustable gauge for installing siding is shown in U.S. Pat. No. 5,094,007, issued to Daniel Gordon on Mar. 10, 1992. The gauge has an elongate member and a shorter member clamped thereto. The shorter member slides along the elongate member and is adjusted by releasing the clamp. A bolt and wingnut clamp the shorter member to the elongate member. The threaded shaft of the bolt and the wingnut project from the elongate member. By contrast, no fastener projects beyond a corresponding elongate member in the present invention. The elongate and shorter members of the present invention are far easier to fabricate than is the device of Gordon.

A jack for supporting clapboards is shown in U.S. Pat. No. 425,173, issued to Edwin W. Brown on Mar. 25, 1890. This jack has a carrier block bearing projecting spikes for engaging clapboards. No such spikes exist in the present invention. Such spikes would potentially damage siding, which is a principal application of the present invention. Also, a guide element present at the rear face of the jack of Brown, where the rear face is that face located away from contact with an installed clapboard, is stepped in that it has a guide and metallic plate which occupy separate planes. By contrast, the corresponding rear surface of the present invention occupies a plane.

U.S. Pat. No. 351,722, issued to William E. Trueblood on Oct. 26, 1886; U.S. Pat. No. 631,315, issued to Thomas B. Meskill on Aug. 22, 1899; and U.S. Pat. No. 3,133,357, issued to Leo A. Gayan on May 19, 1964, illustrate gauges or the like for positioning siding. These devices are considerably more complicated than is the present invention, and have configurations considerably more irregular than the joined parallelepipeds of the present invention which are present when the novel gauge is assembled.

U.S. Pat. No. 4,473,100, issued to Wallace T. Wheeler on Sep. 25, 1984; U.S. Pat. No. 5,623,767, issued to Christopher Colavito on Apr. 29, 1997; and U.S. Pat. No. 5,692,311, issued to Bernard J. Paquin on Dec. 2, 1997, illustrate siding tools that incorporate hand grips. These tools are considerably more complicated than is the present invention, and have configurations considerably more irregular than the joined parallelepipeds of the present invention which are present when the novel gauge is assembled.

The present invention further incorporates a measuring device and a level, tools frequently used while installing siding, which are absent in the above referenced prior art.

None of the above inventions and patents, taken either singly or in combination, is seen to describe the instant invention as claimed.

SUMMARY OF THE INVENTION

The present invention sets forth an uncomplicated gauge which is suitable for cedar, concrete and laminate siding, and is readily utilized by a single person when installing siding. As has been stated previously, cedar is being used to refer to any wood siding of similar profile. The novel gauge is preferably utilized with an S-shaped siding hanger used to support a section of siding in its new position prior to permanent fastening. The gauge comprises a slide bar having a longitudinally oriented slot formed therein, and a stop block adjustably clamped to the slide bar. Outer surfaces of the slide bar occupy opposed planes. The stop block displays similar characteristics, but is smaller. Two cap screws releasably secure the stop block to the slide bar by engaging threaded holes formed in the stop block. The heads of the cap screws occupy the slot, thereby interlocking the stop block to the slide bar unless both screws are fully removed.

The gauge has no projections such as fasteners and barbs as seen in prior art devices which could mar delicate surfaces such as those of siding. Corners and edges of both the slide bar and the stop block are rounded so as to provide further protection of the siding. Both slide bar and stop block are generally parallelepipeds. The stop block is no wider than the slide bar. The gauge is thus readily carried in pockets of apparel without risk of tearing the fabric.

The gauge is utilized by adjusting the stop block to a desired position wherein exposed length of the slide bar corresponds to a dimension a length of siding which is intended to be exposed to view when the length of siding is covered by an overlapping length of siding. With the stop block held firmly against the bottom edge of the last length of siding installed on a building wall, the top of the slide bar is aligned with a predetermined point on the installed length of siding. A new length of siding is positioned such that its bottom edge rests on the top of the slide bar, and is tacked or hung in place, preferably utilizing a siding hanger, or even permanently fastened in place. The same operation is repeated at the opposite end of the partially installed length of siding. The second end of the newly placed length of siding is then fastened in place. Once set to a desired position, the gauge is not adjusted until all siding is fastened in place.

The gauge further features a measuring device and level in the face of at least one of the lengths.

Accordingly, it is one object of the invention to provide a gauge for positioning a length siding at a desired degree of overlap over an installed length of siding.

It is another object of the invention to prevent the gauge from scratching or otherwise marring the siding.

It is a further object of the invention that the novel gauge have only flat and rounded external edges and corners.

Still another object of the invention is that the stop block be no wider than the slide bar.

An additional object of the invention is to enable a single person to install lengths of siding and the like in their permanent positions on buildings.

Yet another object of the invention is to provide a measuring device as an integral part of the siding gauge.

Still another object of the invention is to prove a level as an integral part of the siding gauge.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
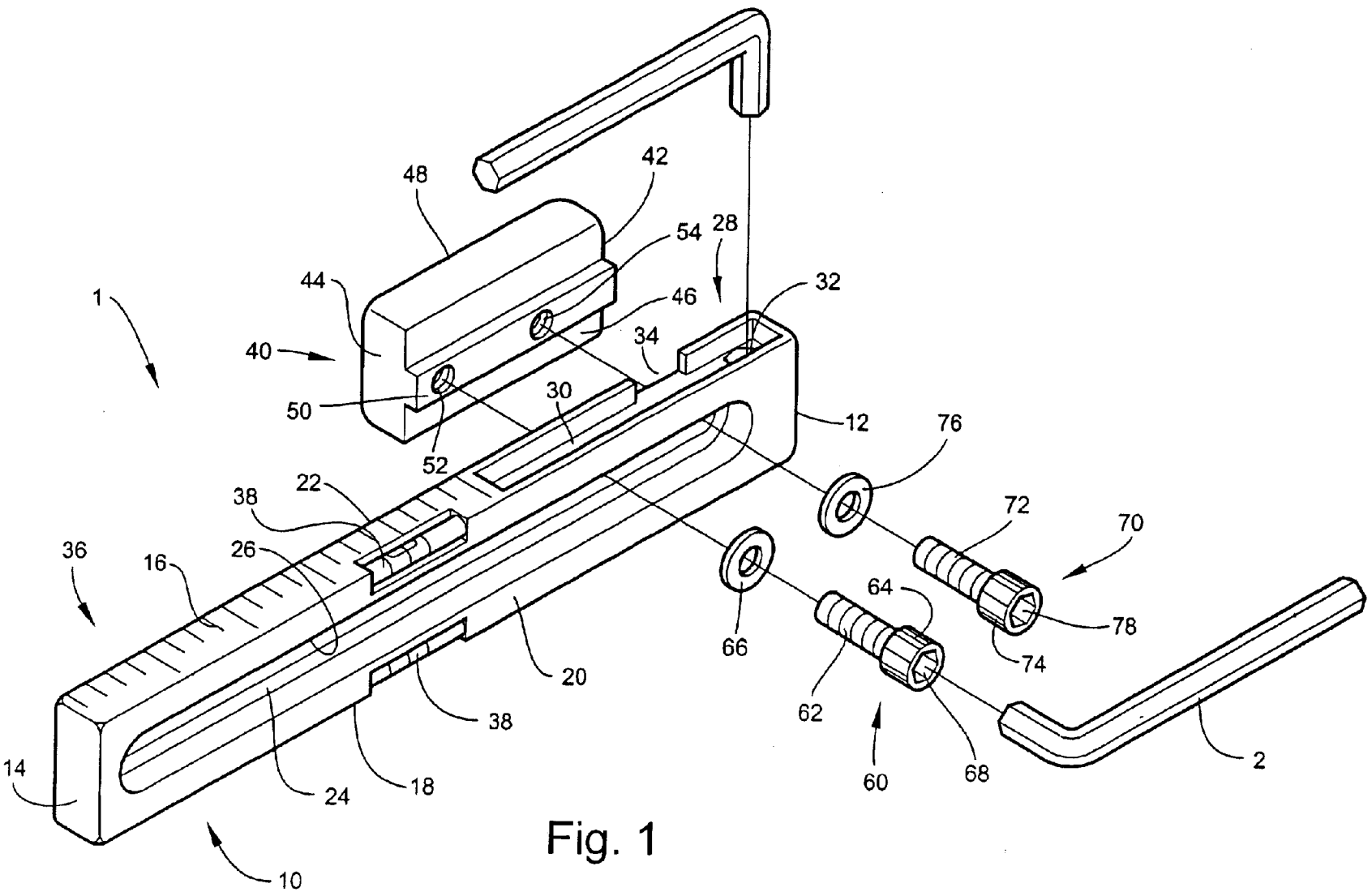
FIG. 1 is an exploded, perspective view of one embodiment of a siding gauge of the present invention.

Turning now to FIG. 1 of the drawings, novel siding gauge 1 is seen to comprise an elongate slide bar 10 and a stop block 40, and cap screws 60, 70.

Slide bar 10 is substantially a parallelepiped having a lower end 12, and upper end 14, a first side 16, a second side 18, a first face 20, and a second face 22. A stepped slot 24 is formed along the longitudinal axis of first face 20 and second face 22 of slide bar 10, although slot 24 need not be centered within slide bar 10. Slot 24 is stepped, having a shoulder 26. Second face 22 is milled so as to have a rough surface (not shown), the purpose of which will be further detailed herein below.

Stop block 40 is also substantially a parallelepiped having a lower end 42, an upper end 44, a first face 46, a second face 48, and two sides. The width of stop block 40 is substantially equal to that of slide bar 10, while the length of stop block 40 is substantially less than that of slide bar 10. A raised tenon 50 runs the length of first face 46 of stop block 40, raised tenon 50 being designed to snugly, but slidably, engage slot 24 of slide bar 10. Threaded holes 52, 54 are formed in stop block 40, threaded holes 52, 54 being spaced apart and centered on the width of raised tenon 50. It would be evident to one skilled in the art that rather than threaded holed 52, 54 being threaded directly in stop block 40, threaded nuts could be imbedded into stop block 40. First face 46 is milled so as to have a rough surface (not shown), the rough surfaces (not shown) of second face 22 and first face 46 providing additional friction to reduce slippage between slide bar 10 and stop block 40 when cap screws 60, 70 are tightened, as will be detailed herein below.

Although cap screws 60, 70 could be any type of fastener which engages both slide bar 10 and stop block 40, it is preferred that the fasteners have threaded shanks 62, 72 and that heads 64, 74 of the fasteners be cylindrical, and nearly as wide as shoulder 26 of slot 24. This relationship, along with that of raised tenon 48 and slot 24, assists in assuring that stop block 40 be longitudinally aligned with slide bar 10 when cap screws 60, 70 are tightened into threaded holes 52, 54. Washers 66, 76 further grip shoulder 26 of slot 24.

Figure 2:
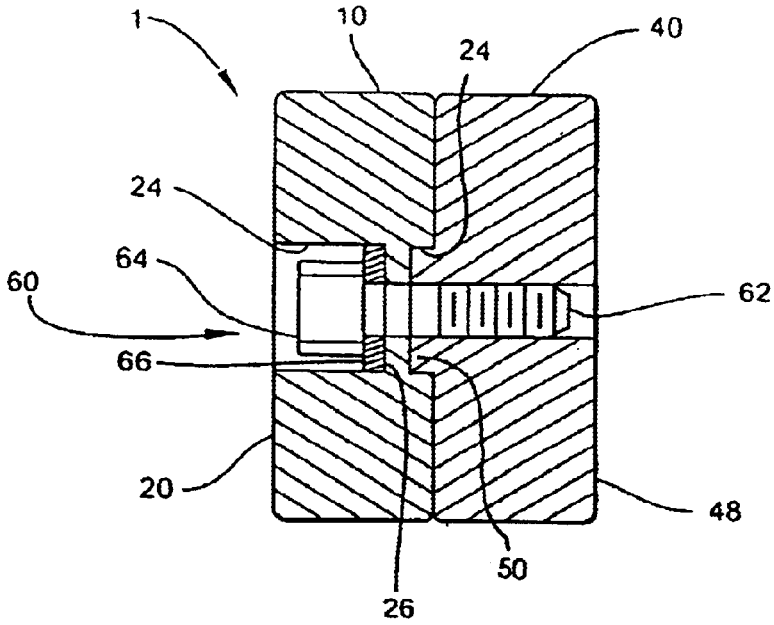
FIG. 2 is an end elevational view of the siding gauge of FIG. 1, shown partially in cross section.

FIG. 2 shows gauge 1 assembled. In referring to FIG. 2, references to cap screw 60 and its subordinate parts apply equally to cap screw 70, hidden from view in FIG. 2. It will be seen that shoulder 26 is nearly the same depth as the height of heads 64, 74 of cap screws 60, 70. Heads 64, 74 do not extend outside surface 20 of slide bar 10 when cap screws 60, 70 pass through slot 24, and are fully tightened. Heads 64, 74 are entrapped within shoulder 26. In a manner similar to that of heads 64, 74, threaded shanks 62, 72 of cap screws 60, 70 do not extend outside surface 48 of stop block 40 when cap screws 60, 70 are fully tightened. Heads 64, 74 of both cap screws 60, 70 are fully contained within shoulder 26 when fully threaded into stop block 40. Gauge 1 is thus both compact when assembled, and also presents no edges, corners, and other projections which could potentially mar siding.

Another feature of gauge 1 is that the edges and corners of both slide bar 10 and stop block 40 are rounded or radiused to the point that the edges and corners do not feel sharp to the touch when gauge 1 is firmly grasped. This feature assists in assuring that gauge 1 and its major components not scratch, dent, or otherwise mar delicate surfaces of siding.

Screws 60, 70 can be tightened quite securely by utilizing hexagonal key 2 (see FIG. 1). Heads 64, 74 have hexagonal sockets 68, 78 for receiving key 2.

A retainer 28 for key 2 may be formed into either one of side 16, 18 by forming a groove 30 in the surface of side 16 or 18 with a hole 32 of a diameter to snugly receive the shorter end of key 2 drilled at one end of groove 30. Cut out 34 along the length of groove 30 provides easy access to the shank of key 2 for removal. It would be evident to one skilled in the art that a spring clip retainer (not shown) could be utilized to hold key 2 in lieu of the snug fit suggested for hole 32.

Either one or both of sides 16, 18 of slide bar 10 may, optionally, be inscribed with a measuring device 36, either in metric, U.S. customary units, or both, with measurements beginning at upper end 14 and running toward lower end 12. Guide 1 may be adjusted by aligning upper end 44 of stop block 40 with the desired measurement on measuring device 36.

Either one or both of sides 16, 18 of slide bar 10 may also, optionally, contain a bubble level 38, thereby conveniently allowing an individual establish a level line for beginning a first course of siding or periodically check subsequent courses of siding for levelness. It would be evident to one skilled in the art that level 38 could be of an electronic variety with equal effectiveness.

Figure 3:
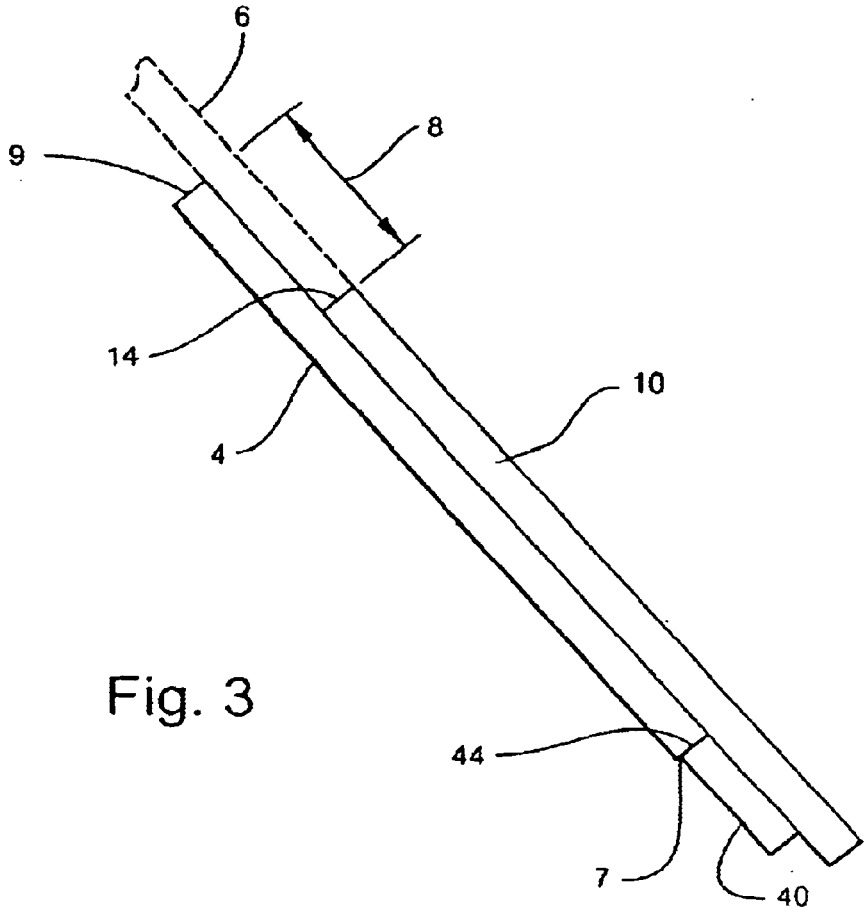
FIG. 3 is an exaggerated environmental diagrammatic view of how the siding gauge is used.
Figure 4:
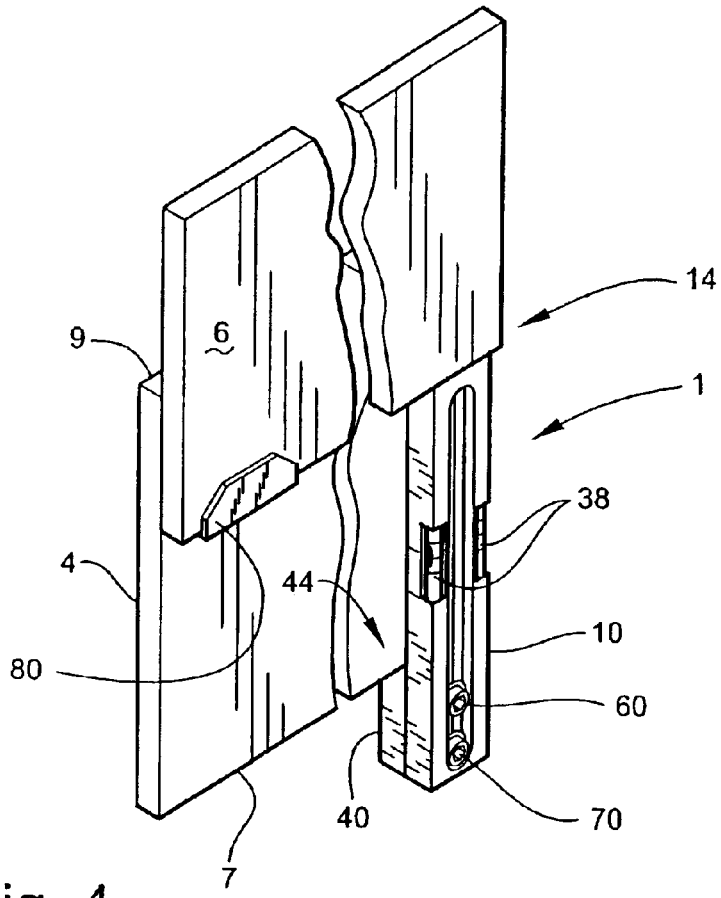
FIG. 4 is an environmental perspective view of how the invention is used.

FIGS. 3 and 4 show how gauge 1 is used. Turning first to FIG. 3, a section of a length of siding 4 to be overlapped by a subsequently installed length of siding 6 (shown in broken lines in FIG. 3) is predetermined to have a height 8. This determination will establish how much of siding 4 is exposed. Next, position of stop block 40 along slide bar 10 is established such that when upper surface 44 of stop block 40 abuts lower surface 7 of siding 4, upper surface 14 of slide bar 10 is spaced apart from upper surface 9 of siding 4 by a distance equal to height 8. Screws 60, 70 are tightened with stop block 40 in the position shown in FIG. 3.

Figure 5:
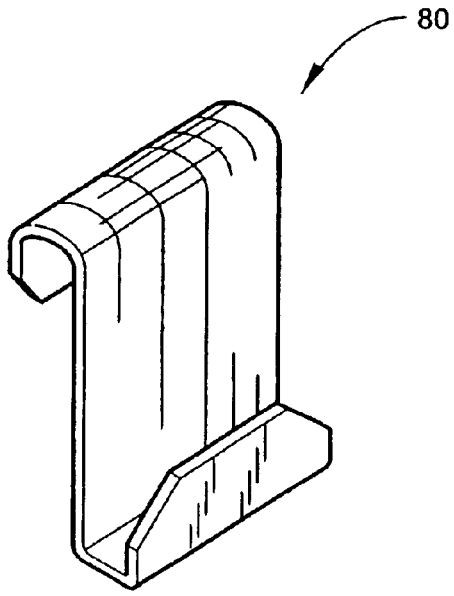
FIG. 5 is a perspective view of siding hanger used with the siding gauge of FIG. 1.

Referring particularly to FIG. 4, length of siding 6 is placed with its lower edge abutting surface 14 of slide bar 10. One end of the length of siding 6 is positioned relative to siding 4 utilizing gauge 1 as described above. That end of siding 6 may be tacked, suspended on a siding hanger 80 (shown separately in FIG. 5), or otherwise fastened. With the fastened end of siding 6 held against the wall or other environmental surface receiving siding, the opposite end is positioned and fastened by the installer. Positioning is accomplished by performing the same steps utilized to position the first end of siding 6, employing gauge 1 as described above. The second end to be positioned is then suitably permanently fastened. The first end is also permanently fastened. As long as lengths of siding being installed have constant dimensions, the amount of "weather" or section of exposed siding will remain the same throughout all courses of siding which are installed.

Figure 5A:
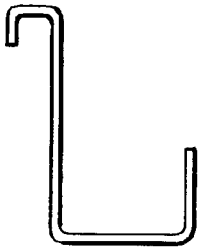
FIGS. 5*a*–5*c* are side elevational views of the various siding hangers of FIG. 5.
Figure 5B:
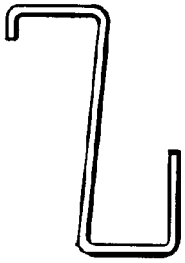
Figure 5C:
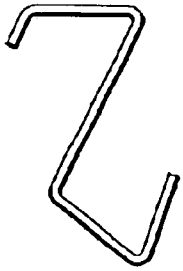

FIGS. 5*a*–5*c* show preferred configurations of hanger 80. Hanger 80 is configured in the form of an S-shaped hook when viewed in side elevation, the difference in each embodiment being in the side elevation profile. The edges and corners are rounded or beveled to avoid scratching siding. Hanger 80 is preferably formed from a thin sheet of plastic or metal strong enough to support a section of siding when hanger 80 engages a second section of siding, as shown in FIG. 4. Hanger 80 is thin enough to be maneuvered into the position shown in FIG. 4, yet strong enough to avoid deforming either section of siding or deforming itself.

While gauge 1 may be employed as a tool in installing siding, it should be noted that utilizing hanger 80 enables a single installer to install siding single handedly. Therefore, gauge 1 and hanger 80 may be incorporated into a kit for installing siding. The kit includes gauge 1 and at least one hanger 80 and optionally additional hangers 80. FIG. 5*a* depicts a hanger 80 adapted for siding materials such as, but not limited to, cedar (again, cedar is referring to any siding of similar profile); FIG. 5*b* depicts a hanger 80 adapted for concrete fiber siding, and FIG. 5*c* depicts a hanger 80 adapted for laminated lap siding.

The present invention is most advantageously used with cedar, concrete or laminated siding, but may also be utilized with clapboard, roofing shingle, and other materials which must be placed in overlapping fashion.

The invention is susceptible to variations and modifications which may be introduced thereto without departing from the inventive concept. For example, location of slot 24 and holes 52, 54 may be reversed, although this would likely necessitate additional threaded holes (not shown). Also, the type of fastener may differ from cap screws 60, 70.

It is to be understood that the present invention is not limited to the embodiments described above, but encompasses any and all embodiments within the scope of the following claims.

What is claimed is:

1. A siding gauge comprising:

an elongate slide bar, said slide bar being substantially a parallelepiped having a lower end, an upper end, a first side, a second side, a first face, a second face, and a stepped slot formed along the length of said slide bar, said stepped slot passing through the first face and the second face, said stepped slot having a stepped portion formed alone the length of the first face and a stepped portion formed along the length of the second face, wherein said slide bar is devoid of projections therefrom;

a stop block, said stop block being substantially a parallelepiped having a lower end, an upper end, a first face, a second face, and two sides, said first face having a raised tenon disposed the length thereof, said tenon adapted to slidably engage said stepped slot, said lower end, said upper end, said second face and said two sides being devoid of any projections therefrom, the width of said stop block being substantially equal to the width of said slide bar, and the length of said stop block being less than that of said slide bar;

a fastener having a shank and a broad head, wherein said shank passes through said stepped slot and engages said raised tenon of said stop block, said broad head engages said stepped slot and is entrapped therein when said shank engages said stop block, and said broad head is fully contained within said stepped slot when fully engaging said stop block; and a storage retainer for receiving an L-shaped hexagonal key, said storage retainer comprises a groove in one of said first side and said second side of said slide bar, and a hole in the bottom of said groove, said hole adapted to receive the shorter end of said key.

2. The gauge, as defined in claim 1, wherein said slide bar has rounded edges and corners and said stop block has rounded edges and corners.

3. The gauge, as defined in claim 1, wherein said fastener is a screw having threads, and said stop block has a threaded hole formed in said raised tenon matingly compatible with said threads of said screw.

4. The gauge, as defined in claim 3, wherein said screw is a cap screw wherein said broad head has a cylindrical outer surface and a socket disposed to receive a key for rotating said cap screw.

5. The gauge, as defined in claim 1, wherein said fastener comprises two cap screws each having a threaded shank and a cylindrical broad head having a hexagonal socket disposed to receive a hexagonal key for rotating said cap screw and said stop block has a two threaded holes formed in said raised tenon, each of said two threaded holes being matingly compatible with said threads of one of said screws.

6. The gauge, as defined in claim 1, further comprising at least one level, each of said at least one level situated in one of said first side and said second side of said slide bar.

7. The gauge, as defined in claim 6, wherein said at least one level comprises at least one from the group consisting of bubble level and electronic level.

8. The gauge, as defined in claim 1, further comprising a measuring device inscribed upon at least one of said first side and said second side of said slide bar.

9. The gauge, as defined in claim 8, wherein measurements of said measuring device comprise measurements from at least one of the group consisting of metric and U.S. customary units.

10. The gauge, as defined in claim 1, wherein said storage retainer further comprises a notch formed in a side of said groove, said notch adapted to facilitate removal of said key from said storage retainer.

11. A kit for installing siding, comprising:

a siding gauge comprising:

an elongate slide bar, said slide bar being substantially a parallelepiped having a lower end, an upper end, a first side, a second side, a first face, a second face, and a stepped slot formed along the length of said slide bar, said stepped slot passing through the first face and the second face, said stepped slot having a stepped portion formed along the length of the first face and a stepped portion formed along the length of the second face, wherein said slide bar is devoid of projections therefrom, said slide bar further comprising:

at least one level, said at least one level situated in at least one of said first side and said second side of said slide bar, a measuring device inscribed upon at least one of said first side and said second side of said slide bar, and a storage retainer for an L-shaped hexagonal key, said storage retainer further comprising a groove in one of said first side and said second side of said slide bar, a hole disposed in the bottom of said groove and adapted to receive the short end of said hexagonal key;

a stop block, said stop block being substantially a parallelepiped having a lower end, an upper end, a first face, a second face, and two sides, said first face having a raised tenon disposed the length thereof, said tenon adapted to slidably engage said stepped slot, and said lower end, said upper end, said second face and said two sides being devoid of any projections therefrom, the width of said stop block being substantially equal to the width of said slide bar, and the length of said stop block being substantially less than the length of said slide bar, wherein said slide bar and said stop block have rounded edges, and rounded corners and said stop block has a plurality of threaded holes; and a plurality of threaded fasteners each of said fasteners having a shank and a cylindrical broad head, said head having a hexagonal socket, wherein each of said shanks passes through said stepped slot and threads into said threaded holes of said stop block, each said broad head engages said stepped slot and is entrapped therein when said shank is fully tightened within said stop block, and said cylindrical broad heads are fully contained within said stepped slot when fully threaded into said stop block; and at least one siding hook dimensioned and configured to engage a length of siding and support thereon a second length of siding roughly in position for final installation.

12. A kit for installing siding, as defined in claim 11, wherein said level comprises at least one from the group consisting of bubble level and electronic level.

13. A kit for installing siding, as defined in claim 11, wherein the measurements of said measuring device comprise at least one of the group consisting of metric and U.S. customary units.

14. A kit for installing siding, comprising:

a siding gauge comprising:

an elongate slide bar, said slide bar being substantially a parallelepiped having a lower end, an upper end, a first side, a second side, a first face, a second face, and a stepped slot formed along the length of said slide bar, said stepped slot passing through the first face and the second face, said stepped slot having a stepped portion formed along the length of the first face and a stepped portion formed along the length of the second face, wherein said slide bar is devoid of projections therefrom, said slide bar further comprising:

at least one level, said at least one level situated in at least one of said first side and said second side of said slide bar, a measuring device inscribed upon at least one of said first side and said second side of said slide bar, and a storage retainer for an L-shaped hexagonal key, said storage retainer further comprising a groove in one of said first side and said second side of said slide bar, a hole disposed in the bottom of said groove and adapted to receive the short end of said hexagonal key;

a stop block, said stop block being substantially a parallelepiped having a lower end, an upper end, a first face, a second face, and two sides, said first face having a raised tenon disposed the length thereof, said tenon adapted to slidably engage said stepped slot, and said lower end, said upper end, said second face and said two sides being devoid of any projections therefrom, the width of said stop block being substantially equal to the width of said slide bar, and the length of said stop block being substantially less than the length of said slide bar, wherein said slide bar and said stop block have rounded edges, and rounded corners and said stop block has a plurality of threaded holes; and a plurality of threaded fasteners each of said fasteners having a shank and a cylindrical broad head, said head having a hexagonal socket, wherein each of said shanks passes through said stepped slot and threads into said threaded holes of said stop block, each said broad head engages said stepped slot and is entrapped therein when said shank is fully tightened within said stop block, and said cylindrical broad heads are fully contained within said stepped slot when fully threaded into said stop block; and at least one siding hook dimensioned and configured to engage a length of siding and support thereon a second length of siding roughly in position for final installation, said siding hook comprising:

a substantially S-shaped hook having a first, elongate, planar section;

each end of said first section having a short planar second section connected thereto at an angle relative to said first section, each of the second sections extending from said first section in substantially opposite directions from each other; and a pair of short, planar third sections connected to respective ones of said second sections at the ends of the second sections remote from the first section, said third sections extending at an angle relative to said second section, such that they are substantially parallel to said first section and extend generally towards one another;

whereby the first, second, and third sections of the siding hook together form a substantially S-shape;

and wherein said siding hook is adapted to support one siding type of the group: wood, concrete, and laminated by making said second sections to have different lengths from one another and said third sections to have different lengths from one another.

15. A siding gauge comprising:

an elongate slide bar, said slide bar being substantially a parallelepiped having a lower end, an upper end, a first side, a second side, a first face, a second face, and a stepped slot formed along the length of said slide bar, said stepped slot passing through the first face and the second face, said stepped slot having a stepped portion formed along the length of the first face and a stepped portion formed along the length of the second face, wherein said slide bar is devoid of projections therefrom and all edges and corners formed on said slide bar are rounded, said slide bar further comprising a measuring device inscribed upon at least one of said first side and said second side of said slide bar, and a storage retainer for an L-shaped hexagonal key, said storage retainer comprising a groove in one of said first side and said second side of said slide bar which is adapted to receive the long end of said hexagonal key, and a hole disposed in the bottom of said groove and adapted to receive the short end of said hexagonal key;

a stop block, said stop block being substantially a parallelepiped having a lower end, an upper end, a first face, a second face, and two sides, wherein all external edges and corners of said stop block are rounded, said first face of said stop block having a raised tenon disposed the length thereof, said tenon adapted to slidably engage said stepped slot, and said lower end, said upper end, said second face and said two sides being devoid of any projections therefrom, the width of said stop block being substantially equal to the width of said slide bar, and the length of said stop block being substantially less than the length of said slide bar, wherein said stop block has a plurality of threaded holes;

a plurality of threaded fasteners, each of said fasteners having a shank and a cylindrical broad head, each said head having a hexagonal socket, wherein each of said shanks passes through said stepped slot and threads into said threaded holes of said stop block and each said broad head engages said stepped slot and is entrapped therein when said shank is fully tightened within said stop block; and said cylindrical broad heads are fully contained within said stepped slot when fully threaded into said stop block.

16. A siding gauge, as defined in claim 15, further comprising at least one level, said at least one level situated in at least one of said first side and said second side of said slide bar, said at least one level comprising at least one from the group consisting of bubble level and electronic level.

17. A siding gauge, as defined in claim 15, wherein the measurements of said measuring device comprise at least one of the group consisting of metric and U.S. customary units.

* * * * *